US009620068B2

(12) United States Patent
Xu

(10) Patent No.: US 9,620,068 B2
(45) Date of Patent: Apr. 11, 2017

(54) RESIDUAL IMAGE REMOVING METHOD AND LIQUID CRYSTAL DISPLAY USING SAME

(71) Applicant: SHENZHEN CHINA STAR OPTOELECTRONICS TECHNOLOGY CO., LTD., Shenzhen, Guangdong (CN)

(72) Inventor: Liang Xu, Guangdong (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 14/647,111

(22) PCT Filed: Jan. 19, 2014

(86) PCT No.: PCT/CN2014/070861

§ 371 (c)(1),
(2) Date: May 25, 2015

(87) PCT Pub. No.: WO2015/032179

PCT Pub. Date: Mar. 12, 2015

(65) Prior Publication Data

US 2016/0171937 A1 Jun. 16, 2016

(30) Foreign Application Priority Data

Sep. 4, 2013 (CN) ..... 2013 1 0400303

(51) Int. Cl.
*G09G 3/34* (2006.01)
*G09G 3/36* (2006.01)

(52) U.S. Cl.
CPC ..... *G09G 3/36* (2013.01); *G09G 2320/0247* (2013.01); *G09G 2320/0257* (2013.01)

(58) Field of Classification Search
CPC ... G09G 3/36; G09G 5/00; G09G 3/34; G06F 3/038; G02B 26/00; G02F 1/01
See application file for complete search history.

(56) References Cited

U.S. PATENT DOCUMENTS 4,734,692 A 3/1988 Hosono et al.
2003/0095094 A1* 5/2003 Goden ..... G02F 1/167 345/107

(Continued)

FOREIGN PATENT DOCUMENTS

CN 101236317 A 8/2008
CN 101382711 A 3/2009

(Continued)

OTHER PUBLICATIONS

Yunxia Qu, the International Searching Authority written comments, Jun. 2014, CN.

*Primary Examiner* — Pegeman Karimi

(57) ABSTRACT

The present invention discloses a liquid crystal display including a first common voltage regulator, a second common voltage regulator, a switching circuit, and a sequential controller. The first common voltage regulator regulates a common voltage to minimize a flicker during a switching mode between a white frame and a black frame and set this common voltage as a first common voltage. The second common voltage regulator regulates a common voltage to minimize a flicker during a switching mode between a gray frame and a black frame and set this common voltage as a second common voltage. The sequential controller inserts predetermined number of abnormal frames every predetermined number of normal frames according to a preset scan frequency. The switching circuit is correspondingly connected to the first common voltage regulator and a second common voltage regulator.

10 Claims, 2 Drawing Sheets

(56) References Cited

U.S. PATENT DOCUMENTS

| | | | | |
|---|---|---|---|---|
| 2005/0162365 | A1 | 7/2005 | Aoki | |
| 2006/0209011 | A1* | 9/2006 | Miyasaka | G09G 3/344 345/107 |
| 2006/0274030 | A1* | 12/2006 | Johnson | G09G 3/344 345/107 |
| 2007/0139358 | A1* | 6/2007 | Sakamoto | G09G 3/3446 345/107 |
| 2009/0046114 | A1* | 2/2009 | Lee | G09G 3/2007 345/691 |
| 2009/0213284 | A1 | 8/2009 | Liao et al. | |
| 2011/0261035 | A1* | 10/2011 | Miyazaki | G09G 3/207 345/205 |

FOREIGN PATENT DOCUMENTS

| | | | |
|---|---|---|---|
| CN | 101398550 | A | 4/2009 |
| CN | 101656051 | A | 2/2010 |
| CN | 101727858 | A | 6/2010 |

* cited by examiner

RESIDUAL IMAGE REMOVING METHOD AND LIQUID CRYSTAL DISPLAY USING SAME

FIELD OF THE INVENTION

The invention relates to display technologies, and particularly, to a residual image removing method and a liquid crystal display using same.

BACKGROUND OF THE INVENTION

A liquid crystal display rotates liquid crystal molecules via an electric filed generated between a common electrode and a pixel electrode to display a picture. However, an absolute value of a positive voltage and an absolute value of a negative voltage applied to the common electrode during a polarity inversion of the liquid crystal display do not match each other exactly. Thus, iconic impurity mixed up with the liquid crystal molecules is attracted toward one of the common electrode and the pixel electrode by the asymmetrical voltage during the polarity inversion to form a residual direct current. The iconic impurity gathering at one of the common electrode and the pixel electrode generates an internal electric field when the liquid crystal display is turned off to rotate the liquid crystal molecules, which leads to a residual image.

Therefore, a residual image removing method and a liquid crystal display using same which can solve the above-mentioned problem needs to be provided.

SUMMARY OF THE INVENTION

To solve the above-mentioned problem, the present invention provides a liquid crystal display including a first common voltage regulator, a second common voltage regulator, a switching circuit, and a sequential controller. The first common voltage regulator regulates a common voltage to minimize a flicker during a switching mode between a white frame and a black frame and set this common voltage as a first common voltage. The second common voltage regulator regulates a common voltage to minimize a flicker during a switching mode between a gray frame and a black frame and set this common voltage as a second common voltage. The sequential controller inserts predetermined number of abnormal frames every predetermined number of normal frames according to a preset scan frequency. The switching circuit is correspondingly connected to the first common voltage regulator and a second common voltage regulator to selectively output the first common voltage during the normal frames and the second common voltage during the abnormal frames.

Wherein, taking eight-bite binary of 256 grays scale as a standard, the predetermined gray used to determine the second common voltage is in a range greater than or equal to 48 grays and less than or equal to the 127 grays.

Wherein, the predetermined scan frequency is 60 frames per unit time or 80 frames per unit time.

Wherein, a proportion between the normal scan frame and the abnormal scan frame is 2:1 or 3:1.

Wherein, the sequential controller outputs the switching signal to the switching circuit when the normal scan frame is changed to the abnormal scan frame to control the switching circuit switches an output of first common voltage to an output of the second common voltage.

Wherein, the sequential controller outputs the restoring signal to the switching circuit when the abnormal scan frame is changed to the normal scan frame to control the switching circuit switches an output of the second common voltage to an output of the first common voltage.

A residual image removing method of a liquid crystal display includes alternatively displaying between a white frame and a black frame, regulating a common voltage to minimize the flicker of the displaying frame, and considering the common voltage as the first common voltage; alternatively displaying between a predetermined gray frame and the zero gray frame, regulating the common voltage to minimize the flicker of the displaying frame, and considering the common voltage as the second common voltage; and distributing scan frames into alternative normal frames and abnormal frames according to a predetermined frame proportion in a predetermined scan frequency, driving the liquid crystal display via the first common voltage in the normal frames, and driving the liquid crystal display via the second common voltage in the abnormal frames.

Wherein, taking eight-bite binary of 256 grays scale as a standard, the predetermined gray used to determine the second common voltage is in a range greater than or equal to 48 grays and less than or equal to the 127 grays.

Wherein, the predetermined scan frequency is 60 frames per unit time or 80 frames per unit time.

Wherein, a proportion between the normal scan frame and the abnormal scan frame is 2:1 or 3:1.

The liquid crystal display and the residual image removing method of the liquid crystal display correspondingly applies the first common voltage and the second common voltage to drive the liquid crystal display can make the residual direct current cancel out each other to reduce the residual direct current and remove the residual image during a whole display period.

BRIEF DESCRIPTION OF THE DRAWINGS

In order to illustrate technical schemes of the present invention or the prior art more clearly, the following section briefly introduces drawings used to describe the embodiments and prior art. Obviously, the drawing in the following descriptions just is some embodiments of the present invention. The ordinary person in the related art can acquire the other drawings according to these drawings without offering creative effort.

DETAILED DESCRIPTION OF THE PREFERRED EMBODIMENTS

The following sections offer a clear, complete description of the present invention in combination with the embodiments and accompanying drawings. Obviously, the embodiments described herein are only a part of, but not all of the embodiments of the present invention. In view of the embodiments described herein, any other embodiment obtained by the person skilled in the field without offering creative effort is included in a scope claimed by the present invention.

Figure 1:
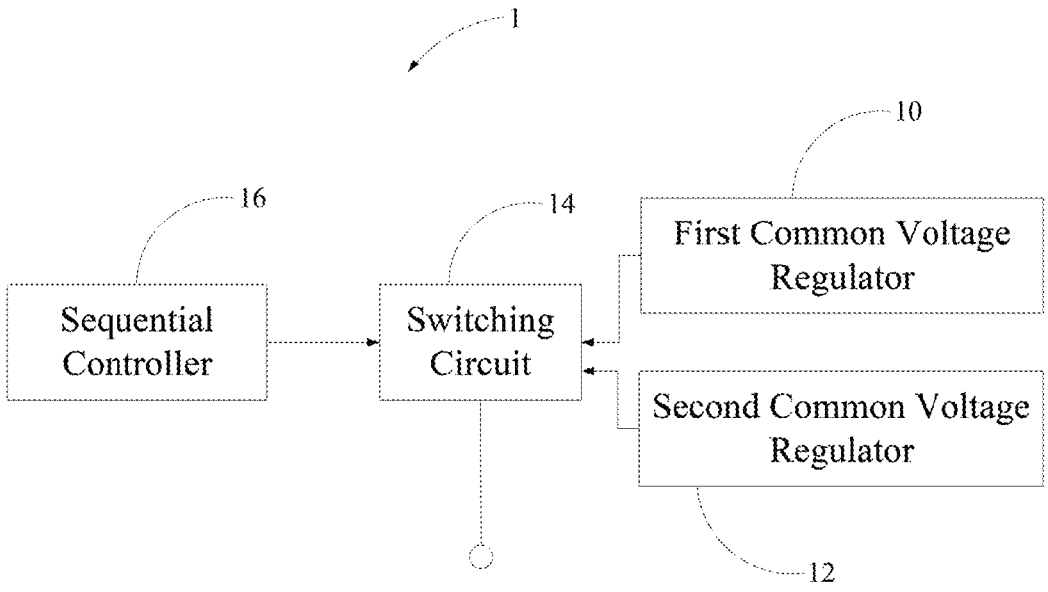
FIG. 1 is a functional block view of a liquid crystal display in accordance with an embodiment of the present invention.

Referring to FIG. 1, a liquid crystal display 1 in accordance with an embodiment of the present invention includes a first common voltage regulator 10, a second common voltage regulator 12, a switching circuit 14, and a sequential controller 16. The first common voltage regulator 10 regulates a common voltage to minimize a flicker during a switching mode between a white frame and a black frame and set this common voltage as a first common voltage. The second common voltage regulator 12 regulates a common voltage to minimize a flicker during a switching mode between a gray frame and a black frame and set this common voltage as a second common voltage. The switching circuit 14 is correspondingly connected to the first common voltage regulator 10 and a second common voltage regulator 12 to selectively output the first common voltage and the second common voltage. The sequential controller 16 inserts predetermined number of abnormal frames every predetermined number of normal frames according to a preset scan frequency. The switching circuit 14 outputs the first common voltage during the normal frames and outputs the second common voltage during the abnormal frames.

Taking eight-bite binary of 256 grays scale as a standard, the first common voltage regulator 10 regulates the common voltage during the switching mode between a 256 grays (white) frame and a zero gray (black) frame to minimize the flicker. Thus, a positive value and a negative value of the common voltage for displaying the 256 grays frame are matched with each other. Therefore, the common voltage regulated by the first common voltage regulator 10 is set as the first common voltage to display a normal frame.

If the gray scale of a brighter frame during the switching mode is reduced from 256 grays to a predetermined lower grays, the flicker become greater when the frame is still driven by the first common voltage. That is, the polarity of the first common voltage becomes asymmetric again when the first common voltage is used to display the predetermined grays frame. The iconic impurity in the liquid crystal molecules is driven by the asymmetrical first common voltage to form a residual direct current which leads to a residual image. At this moment, the second common voltage regulator 12 regulates the common voltage to the second common voltage which minimizes the flicker of the predetermined grays frame. Because a direction of the residual direct current made by the second common voltage is opposite to a direction of the residual direct current made by the first common voltage, to correspondingly apply the first common voltage and the second common voltage to the different scan frames can make the residual direct current cancel out each other to reduce the residual direct current and remove the residual image during a whole display period.

The predetermined gray used to determine the second common voltage is in a range greater than or equal to 48 grays and less than or equal to the 127 grays. In this embodiment, the predetermined gray is 127 grays. In the other alternative embodiment, the predetermined gray is 48 grays.

The sequential controller 16 is used to determine a proportion between a first time period applying the first common voltage and a second time period applying the second common voltage with a predetermined scan frequency. A scan frame is defined as one unit of time period applying the common voltage. A same common voltage is applied during one scan frame. The scan frame applying the first common voltage is defined as a normal scan frame. The scan frame applying the second common voltage is defined as an abnormal scan frame. In this embodiment, the predetermined scan frequency is 60 frames per unit time. A proportion between the normal scan frame and the abnormal scan frame is 2:1. Thai is, every two normal scan frames applying a first common voltage are spaced by one abnormal scan frame applying the second common voltage. In the other alternative embodiments, the predetermined scan frequency is 80 frames per time unit. A proportion between the normal scan frame and the abnormal scan frame is 3:1.

The switching circuit 14 is used to selectively output the first common voltage and the second common voltage according to a switching signal of the sequential controller 16. The sequential controller 16 outputs the switching signal to the switching circuit 14 when the normal scan frame is changed to the abnormal scan frame and output a restoring signal to the switching circuit 14 when the abnormal scan frame is changed to the normal scan frame. The switching circuit 14 switches an output of the first common voltage to an output of the second common voltage when receives the switching signal and switches the output of the second common voltage to the output of the first common voltage when receives the restoring signal.

Figure 2:
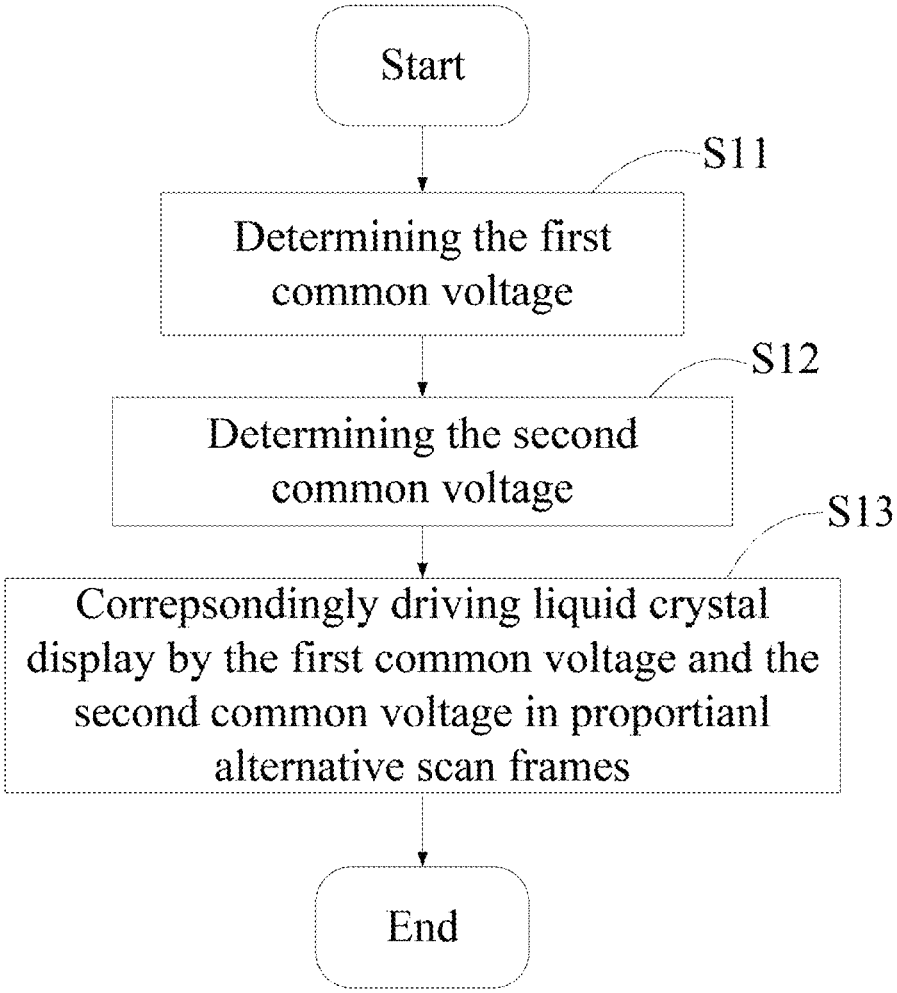
FIG. 2 is a flow chart of steps of a residual image removing method in accordance with an embodiment of the present invention.

Referring to FIG. 2, a residual image removing method in accordance with an embodiment of the present invention includes following steps:

Step S11, to determine the first common voltage, the liquid crystal display 1 alternatively displays between the 256 grays (white) frame and the zero gray (black) frame. The first common voltage regulator 10 regulates the common voltage to minimize the flicker of the displaying frame and considers the common voltage as the first common voltage.

Step S12, to determine the second common voltage, the liquid crystal display 1 alternatively displays between the predetermined gray frame with the gray less than 256 grays and the zero gray frame. The second common voltage regulator 12 regulates the common voltage to minimize the flicker of the displaying frame and considers the common voltage as the second common voltage. The predetermined gray is in a range greater than or equal to 48 grays and less than or equal to the 127 grays. In this embodiment, the predetermined gray is 127 grays. In the other alternative embodiment, the predetermined gray is 48 grays.

Step S13, to alternatively drive the liquid crystal display 1 by the first common voltage and the second common voltage in different scan frames.

In detail, the sequential controller 16 generates a sequential scan signal with a predetermined frequency to control the liquid crystal display 1 to refresh a displaying content of each pixel. The switching circuit 14 selects the first common voltage regulator 10 to output the first common voltage for driving the liquid crystal display 1 at first. The sequential controller 16 generates the switching signal to the switching circuit 14 every predetermined number of the normal scan frames which are driven by the first common voltage from a beginning of the scan. The switching circuit 14 switches to the second common voltage regulator 12 to output the second common voltage for driving the liquid crystal display 1. The sequential controller 16 generates the restoring signal to the switching circuit every predetermined number of the abnormal scan frames which are driven by the second common voltage. The switching circuit 14 switches back to the first common voltage regulator 10 to output the first common voltage for driving the liquid crystal display 1. As such, the sequential controller 16 applies the different common voltages to drive the liquid crystal display 1 during the scan frames with different time proportions by the switching signal and the restoring signal transmitting to the switching circuit 14 every the predetermined number of the scan frames.

It is understood that the switching circuit 14 also can selects the first common voltage regulator to output the first common voltage to drive the liquid crystal display 1 from the beginning of the scan. Correspondingly, the sequential controller 16 insert the predetermined number of the normal scan frames which are driven by the first common voltage every the predetermined numbers of the abnormal scan frames which are driven by the second common voltage from the beginning of the scan.

In this embodiment, the predetermined scan frequency is 60 frames per time unit. The proportion between the normal frame driven by the first common voltage and the abnormal frame driven by the second common voltage is 2:1. In the other alternative embodiment, the predetermined frequency is 80 frames per time unit. The proportion between the normal frame driven by the first common voltage and the abnormal frame driven by the second common voltage is 3:1.

What is said above are only preferred examples of present invention, not intended to limit the present invention, any modifications, equivalent substitutions and improvements etc. made within the spirit and principle of the present invention, should be included in the protection range of the present invention.

What is claimed is:

1. A liquid crystal display comprising:

a first common voltage regulator regulating a common voltage to minimize a flicker during a switching mode between a white frame and a black frame and setting this common voltage as a first common voltage;

a second common voltage regulator regulating the common voltage to minimize a flicker during a switching mode between a predetermined grays frame and a black frame and setting this common voltage as a second common voltage;

a sequential controller inserting predetermined number of abnormal frames every predetermined number of normal frames according to a preset scan frequency; and a switching circuit correspondingly connected to the first common voltage regulator and a second common voltage regulator;

wherein the switching circuit outputs the first common voltage during the normal frames and outputs the second common voltage during the abnormal frames.

2. The liquid crystal display of claim 1, wherein taking eight-bite binary of 256 grays scale as a standard, the predetermined gray used to determine the second common voltage is in a range greater than or equal to 48 grays and less than or equal to the 127 grays.

3. The liquid crystal display of claim 1, wherein the predetermined scan frequency is 60 frames per unit time or 80 frames per unit time.

4. The liquid crystal display of claim 1, wherein a proportion between the normal scan frame and the abnormal scan frame is 2:1 or 3:1.

5. The liquid crystal display of claim 1, wherein the sequential controller outputs the switching signal to the switching circuit when the normal scan frame is changed to the abnormal scan frame to control the switching circuit switches an output of first common voltage to an output of the second common voltage.

6. The liquid crystal display of claim 1, wherein the sequential controller outputs the restoring signal to the switching circuit when the abnormal scan frame is changed to the normal scan frame to control the switching circuit switches an output of the second common voltage to an output of the first common voltage.

7. A residual image removing method of a liquid crystal display, comprising:

alternatively displaying between a white frame and a black frame, regulating a common voltage to minimize a flicker of the displaying frame, and considering the common voltage as a first common voltage;

alternatively displaying between a predetermined gray frame and a zero gray frame, regulating a common voltage to minimize the flicker of the displaying frame, and considering the common voltage as a second common voltage; and distributing scan frames into alternative normal frames and abnormal frames according to a predetermined frame proportion in a predetermined scan frequency, driving the liquid crystal display via the first common voltage in the normal frames, and driving the liquid crystal display via the second common voltage in the abnormal frames.

8. The residual image removing method of claim 7, wherein taking eight-bite binary of 256 grays scale as a standard, the predetermined gray used to determine the second common voltage is in a range greater than or equal to 48 grays and less than or equal to the 127 grays.

9. The residual image removing method of claim 7, wherein the predetermined scan frequency is 60 frames per unit time or 80 frames per unit time.

10. The residual image removing method of claim 7, wherein a proportion between the normal scan frame and the abnormal scan frame is 2:1 or 3:1.

* * * * *